US007556699B2

(12) United States Patent
Cooper et al.

(10) Patent No.: US 7,556,699 B2
(45) Date of Patent: Jul. 7, 2009

(54) METHOD OF PLASMA NITRIDING OF METALS VIA NITROGEN CHARGING

(76) Inventors: Clark VanTine Cooper, 27 Cortland La., Glastonbury, CT (US) 06033-3305; Krassimir G. Marchev, 9 Patricia Rd., Sudbury, MA (US) 01776; Bill C. Giessen, 22 Centre St., Cambridge, MA (US) 02139

( * ) Notice: Subject to any disclaimer, the term of this patent is extended or adjusted under 35 U.S.C. 154(b) by 672 days.

(21) Appl. No.: 10/870,489

(22) Filed: Jun. 17, 2004

(65) Prior Publication Data

US 2005/0279426 A1 Dec. 22, 2005

(51) Int. Cl.
*C23C 8/36* (2006.01)
*C23C 8/24* (2006.01)

(52) U.S. Cl. ..... 148/222; 148/238

(58) Field of Classification Search ..... 148/230, 148/238, 222
See application file for complete search history.

(56) References Cited

U.S. PATENT DOCUMENTS

| | | | | | |
|---|---|---|---|---|---|
| 2,565,360 | A | * | 8/1951 | Dufilho | 148/223 |
| 3,254,542 | A | * | 6/1966 | Harman | 74/595 |
| 3,870,572 | A | * | 3/1975 | Brugger et al. | 148/218 |
| 4,119,443 | A | | 10/1978 | Abe et al. | |
| 4,212,687 | A | * | 7/1980 | Tanaka et al. | 148/222 |
| 4,417,927 | A | * | 11/1983 | Fullman | 148/216 |
| 4,702,779 | A | * | 10/1987 | Madsac et al. | 148/217 |
| 4,844,775 | A | * | 7/1989 | Keeble | 216/68 |
| 5,032,243 | A | * | 7/1991 | Bache et al. | 204/192.34 |
| 5,102,476 | A | | 4/1992 | Wahl | |
| 5,268,044 | A | | 12/1993 | Hemphill | |
| 5,306,531 | A | | 4/1994 | Laurence et al. | |
| 5,599,404 | A | | 2/1997 | Alger | |
| 5,648,174 | A | * | 7/1997 | Yamagata et al. | 428/469 |
| 5,851,313 | A | | 12/1998 | Milam | |
| 6,179,933 | B1 | | 1/2001 | Dodd et al. | |
| 6,660,340 | B1 | | 12/2003 | Kirkpatrick | |
| 6,767,414 | B2 | | 7/2004 | Uehara | |
| 2003/0226625 | A1 | | 12/2003 | Kuehmann et al. | |
| 2006/0048857 | A1 | | 3/2006 | Cooper | |
| 2006/0048858 | A1 | | 3/2006 | Cooper | |

OTHER PUBLICATIONS

Davis et al., The ASM Handbook, "Plasma (Ion) Nitriding", Aug. 1991, vol. 4, pp. 420-421.*

(Continued)

*Primary Examiner*—Roy King
*Assistant Examiner*—Jessee R. Roe
(74) *Attorney, Agent, or Firm*—Carlson, Gaskey & Olds

(57) ABSTRACT

A method of nitriding a metal includes transforming a surface region of a generally nitrogen-free metal into a nitrogen-containing solid solution surface region. A first heating process heats the surface region at a first temperature in the presence of a nitrogen gas partial pressure to form a nitrogen-charged surface portion on the surface region. A second heating process heats the surface region and nitrogen-charged surface portion at a second temperature for a predetermined time to interstitially diffuse nitrogen from the nitrogen-charged surface portion a depth into the surface region. Coincident with the second heating process, an ionized inert or reducing gas removes the nitrogen-charged surface portion. The resulting nitrogen-containing solid solution surface region has a gradual transition in nitrogen concentration.

7 Claims, 2 Drawing Sheets

OTHER PUBLICATIONS

Patnaik, Pradyot (2003). Handbook of Inorganic Chemicals. (pp. 19-23). McGraw-Hill. Online version available at:http://www.knovel.com/knovel2/Toc.jsp?BookID=688&VerticalID=0.*

Elementary Principles of Chemical Processes, 3rd Ed., 2000, Felder-Rousseau, New York, NY: John Wiley & Sons, pp. 196-197.*

ASM International, Materials Park, Ohio, Heat Treating, vol. 4, "Introduction to Surface Hardening of Steels", pp. 259-260, Aug. 1991.*

Ashrafizadah, F. (Available online May 30, 2003), Department of Materials Engineering, Isfahan University of Technology, Iran, "Influence of plasma and gas nitriding on fatigue resistance of plain carbon (Ck45) steel".*

Moller, W., Parascandola, S., Telbizova, T., Gunzel, R., Richter, E., "Surface processes and diffusion mechanisms of ion nitriding of stainless steel and aluminum", Surface & Coatings Technology, 136, 2001, pp. 73-79.*

Gomes et al. ("Alternative High- and Low-Pressure Nitriding of Austenitic Stainless Steel: Mechanisms and Results", Journal of Applied Physics, vol. 9, Nov. 1, 2003, pp. 1-5.

Helena Ronkainen (Tribological Properties of Hydrogenated and Hydrogen-Free Diamond-Like Carbon Coatings, VTT Publication 434, 2001).

Gregory B. Olson, Morris Azrin, Edward S. Wright, "Innovations in Ultrahigh-strength Steel Technology," Proceedings of the 34th Sagamore Conference held Aug. 30-Sep. 3, 1987, Lake George, NY pp. 89-111.

* cited by examiner

METHOD OF PLASMA NITRIDING OF METALS VIA NITROGEN CHARGING

BACKGROUND OF THE INVENTION

This invention relates to case hardening of metal or alloys and, more particularly, to case hardening with a nitrogen and metal or alloy solid solution.

For components formed of metals or alloys it is often desirable to form a hardened surface case on a core of the metal or alloy to enhance the performance of the component. The hardened surface case provides wear and corrosion resistance while the core provides toughness and impact resistance.

There are various conventional methods for forming a hardened surface case. One such typical method, nitriding, utilizes gas, salt bath, or plasma processing. The nitriding process introduces nitrogen to the metal or alloy surface at an elevated temperature. The nitrogen reacts with the metal or alloy to form hard nitride compounds on the metal or alloy surface. This conventional process provides the benefit of a hardened surface case, however, the nitride compounds may be brittle, friable, cause premature failure, or be otherwise undesirable.

The nitride compounds may include a variety of different compositions, such as the $\epsilon$ and $\gamma'$ compositions of iron and nitrogen, as well as various different compositions and crystal structures. The formation of nitride compound compositions introduces some volume fraction within the transformed surface region that possesses properties that are dissimilar to those of the substrate. While the microstructural and compositional transitions are gradual, the presence of nitride compounds having dissimilar properties can lead to deleterious performance in applications that involve contact stress, such as gears and bearings.

Accordingly, it is desirable to provide a method of case hardening that avoids an abrupt change in composition and crystal structure by forming a solid solution region having a gradual transition in nitrogen concentration between the case surface and the core.

SUMMARY OF THE INVENTION

The method of plasma nitriding according to the present invention includes transforming a surface region of a generally nitrogen-free metal or alloy into a nitrogen-containing solid solution surface region. A first heating process forms a nitrogen-charged surface portion on the surface region of the metal or alloy. The heating process includes heating the surface region for a time at a first temperature and in the presence of a nitrogen gas partial pressure. The first temperature is below a heat-treating temperature of the metal or alloy. A second heating process is used to transform the surface region into the nitrogen-containing solid solution surface region by diffusing nitrogen from the nitrogen-charged surface portion into the surface region of the metal or alloy. The temperature of the second heating process is approximately equal to or lower than the temperature of the first heating process to preserve the crystal structure of the surface region, nitrogen-containing solid solution surface region, and the core. An inert or reducing gas, such as argon or hydrogen, may be ionized and used as a diluent to favor the formation of preferred compound compositions and microstructures and/or to inhibit the formation of surface oxides. In addition, the presence of a diluting gas species may be used to sputter the nitrogen-charged surface portion, thereby removing the nitrogen-charged surface portion from the nitrogen-containing solid solution surface region. The nitrogen-containing solid solution surface region has a gradual transition in nitrogen concentration over a desired depth.

The method of plasma nitriding according to the present invention provides a method for case hardening a metal or alloy by forming a nitrogen-containing solid solution surface region having a gradual transition in nitrogen concentration between the case surface and the core.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
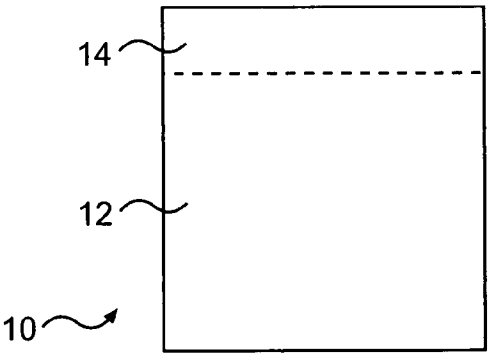
FIG. 1 shows a schematic view of a metal or alloy.

FIG. 1 shows a schematic view of a metal or alloy 10, including a core 12 and a surface region 14 of the core 12. The metal 10 is iron-based and is generally nitrogen-free, although it is to be understood that other metals or alloys will also benefit from the invention.

Figure 2:
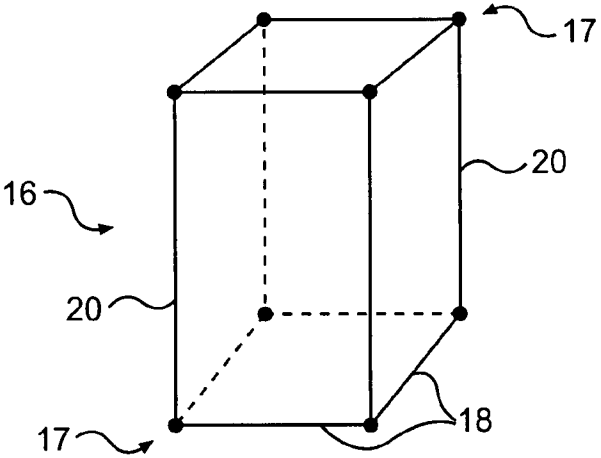
FIG. 2 shows a tetragonal crystal structure.

The core 12 and surface region 14 of the metal 10 have a generally equivalent tetragonal crystal structure 16 (FIG. 2). As illustrated in FIG. 2, the tetragonal crystal structure 16 includes atomic lattice sites 17 forming sides having length 18 which are essentially perpendicular to sides having length 20. In the tetragonal crystal structure 16, the length 18 does not equal the length 20. The tetragonal crystal structure 16 may be face-centered or body-centered. It is to be understood that the iron-based alloy may be formed instead with other crystal structures such as, but not limited to, face centered cubic and body centered cubic.

Figure 3:
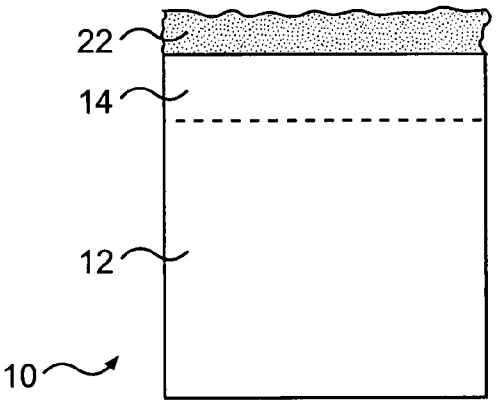
FIG. 3 shows a schematic cross-sectional view of a metal or alloy including a nitrogen-charged surface portion.

FIG. 3 shows a schematic cross-sectional view of the metal 10 and surface region 14, including a nitrogen-charged surface portion 22. A first heating process forms the nitrogen-charged surface portion 22 on the surface region 14. The first heating process includes heating the surface region 14 for a first time at a first temperature and in the presence of a nitrogen gas partial pressure.

Preferably, the first temperature is between 400° F. and 1100° F. Even more preferably, the first temperature is below a heat-treating temperature of the metal 10. The tetragonal crystal structure 16, or other crystal structure, changes when the metal 10 is heated above the heat treating temperature, thereby undesirably changing the dimensions of the metal 10. The heating process may utilize a first temperature far below the heat treating temperature of the metal 10, however, a first temperature that is generally near the heat treating temperature without exceeding the heat treating temperature provides more rapid formation of the nitrogen-charged surface portion 22.

For non-heat-treatable metals or alloys, including those having face centered cubic and body centered cubic crystal structures, selecting a first temperature at the upper end of the 400° F. to 1100° F. range reduces the first time required to form the nitrogen-charged surface portion 22. Furthermore, a high range temperature may avoid formation of deleterious microstructural phases or significantly changing the properties of the core 12 or surface region 14. For example only, the first temperature may be as high as 1100° F. for a 300-series stainless steel, which has a face centered cubic structure.

During the first heating process, the nitrogen gas partial pressure is preferably maintained at about 75% by volume, or above, of a gas atmosphere pressure of about 2.7 torr at a gas flow rate of between 280-300 $std \cdot cm^3 \cdot min^{-1}$. The gas atmosphere includes a generally inert and/or reducing gas or mixture of inert and/or reducing gases with the nitrogen gas.

The heating process is maintained for the first time. The first time is preferably between one and one hundred hours. The first time is a function of the first temperature. If the first temperature is near the heat-treating temperature of the metal 10, the heating process requires less time to form the nitrogen-charged surface portion 22 than if the temperature is far below the heat treating temperature.

Figure 4:
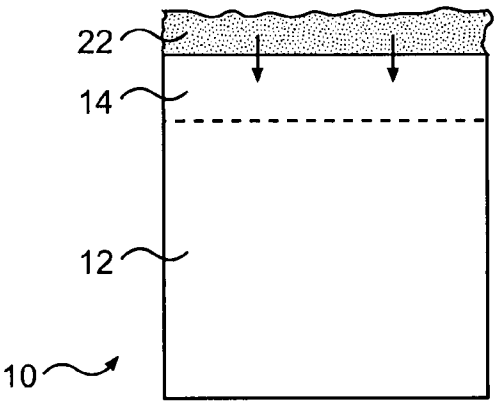
FIG. 4 shows a schematic cross-sectional view of a nitrogen-charged surface portion during interstitial diffusion.

As illustrated in FIG. 4, a second heating process heats the surface region 14 and nitrogen-charged surface portion 22 at a second temperature for a second time to interstitially diffuse nitrogen from the nitrogen-charged surface portion 22 into the surface region 14. The second heating process utilizes a reduced nitrogen partial pressure wherein the gas atmosphere pressure is reduced from about 2.7 torr to about 0.3 torr and the gas flow rate reduced from about 280-300 $std \cdot cm^3 \cdot min^{-1}$ to about 5 $std \cdot cm^3 \cdot min^{-1}$. This generally prevents growth in the thickness of the nitrogen-charged surface portion 22 and also may reduce the risk of unexpectedly heating the metal 10 by particle bombardment. It is to be understood that the required pressures and gas flows may vary according to the metal or alloy composition, crystal structure, or other characteristics.

The second time of the second heating process is preferably between one and one-hundred hours and will vary according to the desired depth of interstitial diffusion into the surface region 14. Longer times result deeper diffusion depths. Preferably, the selected time results in a nitrogen diffusion depth of about 250 micrometers, although shorter times may be used if lesser depths are desired.

Figure 5:
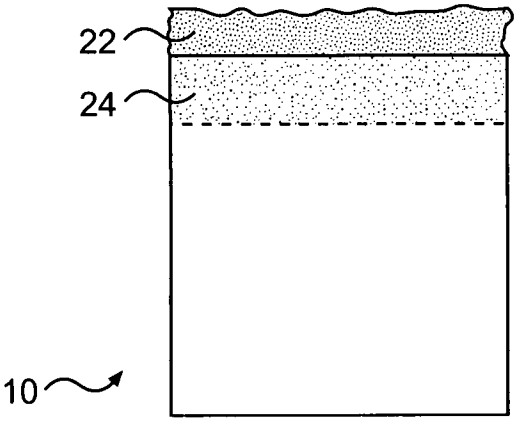
FIG. 5 shows a nitrogen-containing solid solution surface region.

As illustrated in FIG. 5, the nitrogen that interstitially diffuses into the surface region 14 transforms the surface region 14 into a nitrogen-containing solid solution surface region 24. Preferably, the second temperature during the second heating process is approximately equal to or lower than the first temperature of the first heating process to preserve the tetragonal crystal structure 16 of the surface region 14, nitrogen-containing solid solution surface region 24, and core 12.

Figure 6:
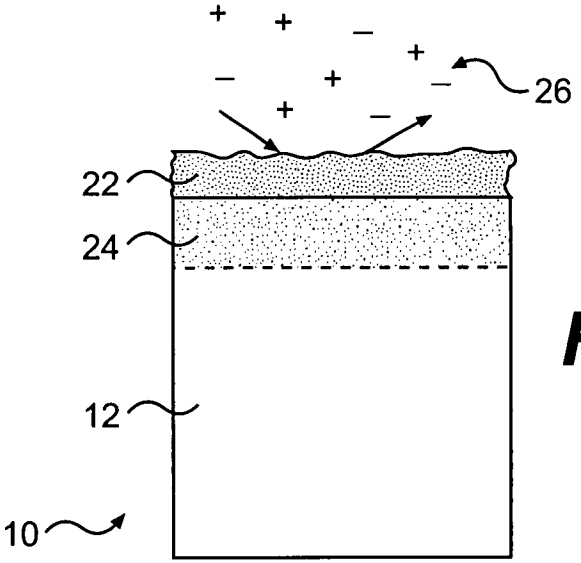
FIG. 6 shows a schematic cross-sectional view of the metal or alloy during nitrogen-charged surface portion removal.
Figure 7:
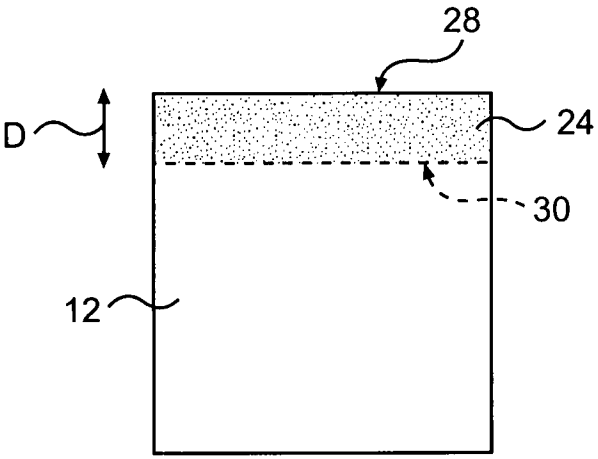
FIG. 7 shows a nitrogen-containing solid solution surface region having a gradual transition in nitrogen concentration between an inner and outer portion.

FIG. 6 shows a schematic cross-sectional view of the metal 10 during a removal step wherein the nitrogen-charged surface portion 22 is removed. The nitrogen-charged surface portion 22 is relatively brittle and maybe friable, delaminate from the nitrogen-containing solid solution surface region 24, or lead to failure through the core 12. Therefore, it is preferable to remove the nitrogen-charged surface portion 22. An ionized inert or reducing gas, such as argon or hydrogen, may be used, as appropriate, to sputter the nitrogen-charged surface portion 22, thereby removing the nitrogen-charged surface portion 22 from the nitrogen-containing solid solution surface region 24 (FIG. 7). Preferably, the gas atmosphere used during the second heating process includes the ionized gas in addition to nitrogen, and the removal step proceeds coincidentally with the second heating process. Conducting the removal step and second heating process coincidentally is particularly preferable when the removal step is the rate controlling step.

Figure 8:
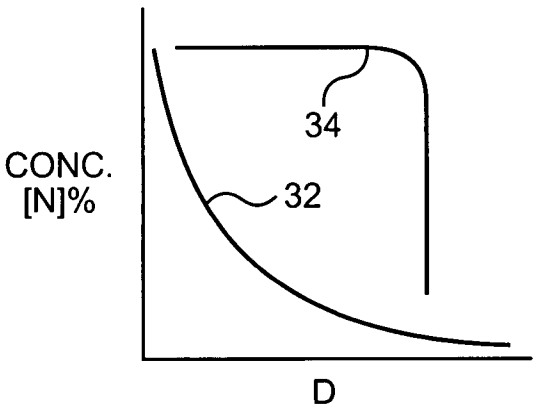
FIG. 8 shows a nitrogen concentration profile over a depth of a nitrogen-containing solid solution surface region.

As illustrated in FIGS. 7-8, the nitrogen-containing solid solution surface region 24 has a gradual transition in nitrogen concentration over a depth D between a surface 28 of the nitrogen-containing solid solution surface region 24 and an inner portion 30 of the nitrogen-containing solid solution surface region 24. The line 32 in FIG. 8 illustrates a gradual nitrogen concentration profile over the depth D. By comparison, the line 34 represents the nitrogen concentration profile before the nitrogen-charged surface portion 22 is removed (FIG. 3). At a shallow depth into the nitrogen-containing solid solution surface region 24 such as near the outer portion 28, the nitrogen concentration is relatively high compared to the nitrogen concentration in the core 12. At a deeper depth, such as near the inner portion 30, the nitrogen concentration is relatively low and approaches the nitrogen concentration of the core 12. It is to be understood that a variety of nitrogen concentration profiles may result from varying the first and second temperatures and times of the heating processes or varying the composition of the metal 10.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A method of nitriding a metal surface comprising the steps of:

(a) heating a surface region of a metal at a first temperature in the presence of a first nitrogen gas partial pressure to form a nitrogen-charged surface portion on the surface region;

(b) heating the surface region and nitrogen-charged surface portion at a second temperature in the presence of a second nitrogen gas partial pressure that is lower than the first nitrogen gas partial pressure;

(c) diffusing nitrogen from the nitrogen-charged surface portion a depth into the surface region to form a nitrogen-containing solid solution surface region having a gradual transition in nitrogen concentration; and (d) removing the nitrogen-charged surface portion with ionized gas.

2. A method of nitriding a metal surface comprising the steps of:

(a) heating a surface region of a metal at a first temperature in the presence of a first nitrogen gas partial pressure that is by volume about 75% or above, having a total gas pressure of about 2.7 torr, and a gas flow rate of between 280-300 $std \cdot cm^3 \cdot min^{-1}$ to form a nitrogen-charged surface portion on the surface region;

(b) heating the surface region and nitrogen-charged surface portion at a second temperature in the presence of a second nitrogen gas partial pressure that is lower than the first nitrogen gas partial pressure, including reducing the first nitrogen gas partial pressure to the second nitrogen gas partial pressure of about 0.3 torr and the gas flow to about 5 $std \cdot cm^3 \cdot min^{-1}$; and (c) diffusing nitrogen from the nitrogen-charged surface portion a depth into the surface region to form a nitrogen-containing solid solution surface region having a gradual transition in nitrogen concentration.

3. A method of nitriding a metal surface comprising the steps of:

(a) heating a surface region of a metal at a first temperature in the presence of a first nitrogen gas partial pressure that is by volume about 75% or above, having a total gas pressure of about 2.7 torr, and a gas flow rate of between 280-300 $std \cdot cm^3 \cdot min^{-1}$ to form a nitrogen-charged surface portion on the surface region;

(b) heating the surface region and nitrogen-charged surface portion at a second temperature in the presence of a second nitrogen gas partial pressure that is lower than the first nitrogen gas partial pressure; and (c) diffusing nitrogen from the nitrogen-charged surface portion a depth into the surface region to form a nitrogen-containing solid solution surface region having a gradual transition in nitrogen concentration.

4. The method as recited in claim 3, wherein said step (a) further comprises:

heating the surface region to a temperature approximately equivalent to the second temperature of said step (b).

5. The method as recited in claim 3, wherein said step (c) further comprises:

diffusing nitrogen from the nitrogen-charged surface portion to a depth about 250 micrometers.

6. The method as recited in claim 3, further comprising heating at the second temperature in the presence of a removal gas.

7. The method as recited in claim 3, further comprising heating at the second temperature to diffuse nitrogen from the nitrogen-charged surface portion into the surface region, wherein the heating is conducted in combination with ionizing a removal gas and removing the nitrogen-charged surface portion using the removal gas.

* * * * *